US008354799B2

(12) United States Patent
Yang et al.

(10) Patent No.: US 8,354,799 B2
(45) Date of Patent: Jan. 15, 2013

(54) BYPASS CIRCUITRY FOR SERIALLY COUPLED LIGHT EMITTING DIODES AND ASSOCIATED METHODS OF OPERATION

(75) Inventors: Eric Yang, Saratoga, CA (US); Kaiwei Yao, San Jose, CA (US)

(73) Assignee: Monolithic Power Systems, Inc., San Jose, CA (US)

( * ) Notice: Subject to any disclaimer, the term of this patent is extended or adjusted under 35 U.S.C. 154(b) by 36 days.

(21) Appl. No.: 13/051,437

(22) Filed: Mar. 18, 2011

(65) Prior Publication Data

US 2012/0056543 A1 Mar. 8, 2012

Related U.S. Application Data

(60) Provisional application No. 61/380,646, filed on Sep. 7, 2010.

(51) Int. Cl.
*H05B 41/16* (2006.01)

(52) U.S. Cl. ..... 315/247; 315/224; 315/209 R; 315/185 S; 315/291

(58) Field of Classification Search ..... 315/247, 315/185 S, 224, 291, 307–311, 312–326
See application file for complete search history.

(56) References Cited

U.S. PATENT DOCUMENTS

| | | | | |
|---|---|---|---|---|
| 8,207,685 | B2 * | 6/2012 | Cheng et al. | 315/306 |
| 2006/0056123 | A1 * | 3/2006 | Aoyagi et al. | 361/56 |
| 2008/0164854 | A1 * | 7/2008 | Lys | 323/226 |
| 2009/0323238 | A1 * | 12/2009 | Gehrke | 361/56 |
| 2011/0006689 | A1 * | 1/2011 | Blanchard et al. | 315/121 |

* cited by examiner

*Primary Examiner* — Tuyet Thi Vo
(74) *Attorney, Agent, or Firm* — Perkins Coie LLP

(57) ABSTRACT

The present technology is generally related to LED bypass circuits and associated methods of operation. In one embodiment, an LED bypass circuit includes a monitoring circuit and a bypass switch. The monitoring circuit is coupled to the LED to monitor the differential voltage across the LED. The bypass switch is coupled to the LED in parallel. When an open status is detected by the monitoring circuit, the bypass switch is turned on to bypass the LED.

14 Claims, 4 Drawing Sheets

BYPASS CIRCUITRY FOR SERIALLY COUPLED LIGHT EMITTING DIODES AND ASSOCIATED METHODS OF OPERATION

CROSS-REFERENCE TO RELATED APPLICATION(S)

This application claims priority to U.S. Provisional Application Ser. No. 61/380,646, filed on Sep. 7, 2010, the entirety of which is incorporated herein by reference.

TECHNICAL FIELD

The present technology is related generally to light emitting diodes ("LEDs"), and particularly, is related to bypass circuits configured to bypass an open circuited and/or otherwise defective LED.

BACKGROUND

White LEDs (WLEDs) have gained significant applications in the display and general illumination market. One example is the WLED street lamp application. In another example, traditional cold cathode fluorescent lamp ("CCFL") backlighting is being replaced by LED backlight in the LCD TV market. In such applications, as shown in FIG. 1, a large number of LEDs can be coupled in series as an LED string to provide a desired brightness. The LED string can be driven by a voltage supply as high as 200V. Multiple strings are further configured to offer the desired backlight. The serially connected LEDs have a uniform current and less power consumption than other configurations. However, if any LED in a string is damaged and becomes open circuited, the whole string is off.

A conventional solution is to bypass an open circuited LED by using a Zener diode. As shown in FIG. 1, a Zener diode triggered snapback transistor ZD is placed in parallel with one of the serially coupled LEDs A. The Zener diode ZD can have a breakdown voltage higher than a normal forward voltage of the LEDs A. Thus, in normal operation, the Zener diodes ZD are open and do not consume any power. If an LED A in the string becomes open circuited, the supply voltage $V_{SUP}$ (a differential voltage between Sup+ and Sup−) builds up across the open LED A, and breaks down the corresponding Zener diode ZD to conduct. Once the Zener diode ZD conducts, it triggers a snapback and clamps the voltage $V_A$ across the open LED A at a clamping voltage of the Zener diode ZD.

However, the foregoing technique has several drawbacks. First, power consumption of Zener diodes is not low. For example, the snapback clamping voltage of Zener diodes is typically around 5V and has strong dependency on manufacturing processing, operating temperatures, and conduction current levels. Also when the failed LED is returned to normal operation and/or the corresponding Zener diode ZD has a temporary false trigger (e.g., by a spike in the power supply or a current spike during LED startup), the Zener diode ZD snapbacks and cannot recover unless the entire LED string is rebooted.

DETAILED DESCRIPTION

Several embodiments of the present technology are described below with reference to bypass circuits for serially coupled LEDs and associated methods of operation. As used hereinafter, the term "LED" encompasses LEDs, laser diodes ("LDs"), polymer LEDs ("PLEDs"), and/or other suitable light emitting diodes. Many specific details that relate to certain embodiments are set forth in the following text to provide a thorough understanding of these embodiments. Several other embodiments can have configurations, components, and/or processes that are different from those described below. A person skilled in the relevant art, therefore, will appreciate that additional embodiments may be practiced without several of the details of the embodiments shown in FIGS. 2-5.

Figure 1:
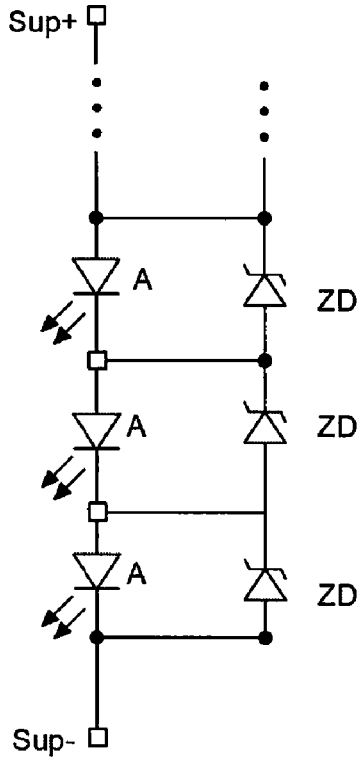
FIG. 1 (Prior Art)
FIG. 1 shows an LED string with a conventional open LED bypass circuit having parallel connected Zener diodes in accordance with the prior art.
Figure 2:
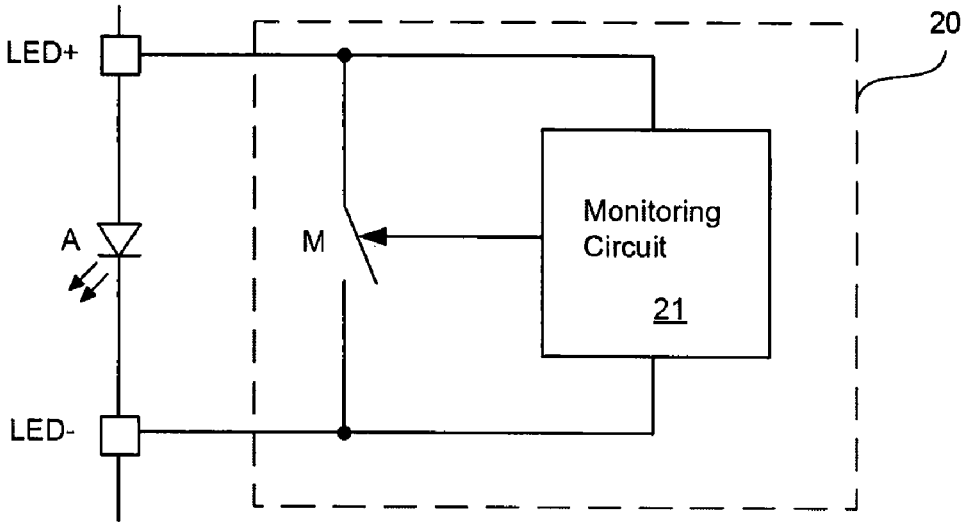
FIG. 2 is a schematic circuit diagram illustrating an open LED bypass circuit in accordance with embodiments of the present technology.

FIG. 2 is a schematic circuit diagram illustrating an open LED bypass circuit 20 in accordance with embodiments of the present technology. As shown in FIG. 2, the bypass circuit 20 is coupled across an LED A to monitor the status of the LED A, and is configured to bypass the LED A when open status of the LED A is detected. Even though only certain components are shown in FIG. 2, in other embodiments, the bypass circuit 20 can also include switches, diodes, transistors, and/or other suitable components in addition to or in lieu of the components shown in FIG. 2.

In certain embodiments, the LED A is serially connected to other LEDs (not shown) in a string of LEDs supplied by a power supply. Though only one LED A is shown in FIG. 2 as a target circuit to be bypassed, in other embodiments, the target circuit may include any number of LEDs, electroluminescent devices, and/or other illumination devices configured as a single device, a string of devices, an array of devices, and/or other suitable arrangements. In other embodiments, the LED A may be connected to other LEDs in other suitable arrangements.

As shown in FIG. 2, the bypass circuit 20 comprises a monitoring circuit 21 and a switch M. The monitoring circuit 21 monitors the status of the LED A. In one embodiment, the monitoring circuit 21 monitors the status of LED A by monitoring the differential voltage $V_{LED+}$-$N_{LED-}$ across the LED A. Thus input terminals of the monitoring circuit 21 are coupled to the anode LED+ of the LED A and to the cathode LED− of the LED A, respectively, to monitor the differential voltage $V_{LED+}$-$N_{LED-}$ across the LED A. The term "couple" generally refers to multiple ways including a direct connection with an electrical conductor and an indirect connection through intermediate diodes, resistors, capacitors, and/or other intermediaries. Thus, the monitoring circuit is coupled to monitor the differential voltage generally and refers to monitoring the differential voltage across the target circuit by either a direct connection or an indirect connection. In other embodiments, the monitoring circuit 21 can also monitor a current, a rate of change in voltage and/or current, and/or other suitable parameters for monitoring the status of the LED A.

The bypass switch M is coupled to the LED A in parallel. The bypass switch M has a control end coupled to the output of the monitoring circuit 21. Thus, when M is turned on by the monitoring circuit 21, the LED A is bypassed with current flowing through the switch M, and the other LEDs (not shown) in a string continue to produce backlight. In one embodiment, the switch M is a MOSFET (Metal-Oxide-Semiconductor Field-Effect Transistor). The MOSFET can be either N type or P type. Other types of switches such as BJT (Bipolar Junction Transistor) or JFET (Junction Field Effect Transistor) can also be adopted as the bypass switch M. The on voltage drop $V_{ON}$ of the switch M is substantially lower compared to the clamping voltage of a Zener diode, and thus power consumption accordingly is substantially lower. In one example, the switch M with a MOSFET can have an on voltage drop of about 50 mV.

Continuing with FIG. 2, when an LED A fails and/or is otherwise in an open status, the supply voltage supplying the entire LED string builds up on the open LED A, and its forward voltage $V_A$ ($V_{LED+}$-$V_{LED-}$) rises. When this situation is detected by the monitoring circuit 21, the switch M is turned on to bypass the damaged LED A. In one example, the monitoring circuit 21 monitors and compares the forward voltage $V_A$ to a threshold voltage. When $V_A$ is higher than the threshold voltage, open status of the LED A is indicated by the monitoring circuit 21 and the switch M is turned on. Thus, a current path forms through the bypass switch M, and the remaining LEDs in the LED string remain in normal operation.

During the open status of the LED A, the switch M is controlled by the output signal of the monitoring circuit 21 to be periodically deactivated (turned off) to check if the open LED heals back to its normal operation. If the LED A remains in open status, once the switch M is turned off, the forward voltage $V_A$ rises again and exceeds the threshold voltage, and the switch M is turned on again and repeats this periodical function. When the LED A heals back to normal status, for example, the false triggering situation is eliminated or the failed LED is replaced with a new LED. Once the switch M is turned off, the forward voltage $V_A$ is lower than the threshold voltage, the bypass switch M is kept off and the bypass circuit 20 will not interfere with the normal operation of the LED A.

Figure 3:
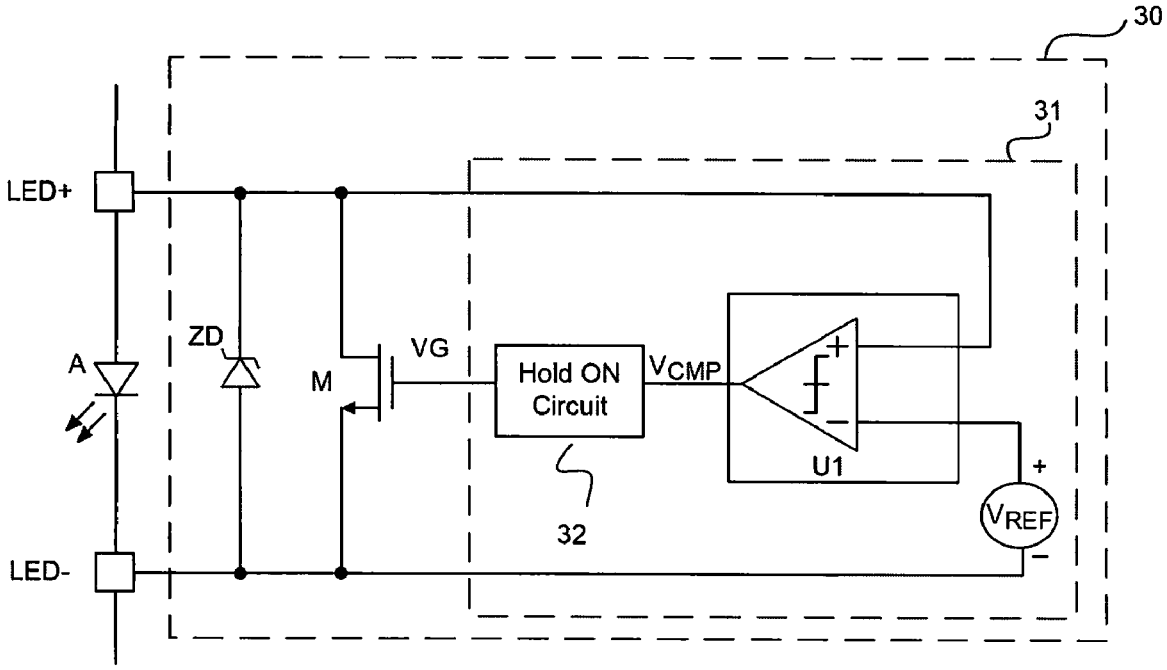
FIG. 3 is a schematic circuit diagram illustrating another open LED bypass circuit in accordance with embodiments of the present technology.

FIG. 3 shows an open LED bypass circuit 30 in accordance with embodiments of the present technology. The bypass circuit 30 comprises a monitoring circuit 31, a bypass switch M, and a Zener diode ZD. The monitoring circuit 31 comprises a comparator U1 and a hold-on circuit 32. The non-inverting input of the comparator U1 is coupled to the anode of the LED A, and the inverting input of the comparator U1 is coupled to a reference voltage $V_{REF}$. The reference voltage source of $V_{REF}$ has its anode connected to the inverting input of the comparator U1 and has its cathode coupled to the cathode of the LED A. In this configuration, the comparator U1 is coupled across the two ends LED+ and LED− of the LED A to compare the forward voltage $V_A$ to a reference voltage $V_{REF}$. In one embodiment, the reference voltage $V_{REF}$ is generated by the bypass circuit 30. In another embodiment, $V_{REF}$ is an external signal. Yet in another embodiment, the value of the reference voltage $V_{REF}$ can be modulated.

Now referring to the hold-on circuit 32, the hold-on circuit 32 is coupled between the comparator U1 and the switch M. The input terminal of the hold-on circuit 32 is coupled to receive the output signal $V_{CMP}$ of the comparator U1. The output terminal of the hold-on circuit 32 is coupled to the control end of the switch M with the output signal $V_G$. When $V_A$ is higher than $V_{REF}$, the output signal $V_{CMP}$ of the comparator U1 has a logic HIGH and the output signal $V_G$ of the monitoring circuit 31 is triggered to a HIGH level, thus the switch M is turned on. The HIGH level of the $V_G$ signal is maintained by the hold-on circuit 32 for a period of time. In another embodiment, the monitoring circuit 31 can keep the switch M on until the bypass circuit 30 restarts.

The bypass switch M is coupled in parallel to the LED A. In the embodiment shown in FIG. 3, the switch M is an N type MOSFET. The drain of the switch M is coupled to the anode of the LED A, the source of M is coupled to the cathode of the LED A, and the gate of M is connected to the output terminal of the monitoring circuit 31. Thus, when signal $V_G$ is HIGH, the switch M is turned on, and the LED A is bypassed with current flowing through the switch M, and the other LEDs in a string (not shown) continue to produce backlight. In one embodiment, the switch M is a LDMOS (Lateral Double-diffused MOSFET) integrated with the monitoring circuit 31 on a single semiconductor substrate. Though N type MOSFET is featured in this embodiment, P type MOSFET or other types of switches such as BJT (Bipolar Junction Transistor) can also be adopted as the bypass switch M.

In the illustrated embodiment, a Zener diode ZD is coupled in parallel with the target LED A, with its cathode coupled to the anode of LED A and its anode coupled to the cathode of LED A. The clamping voltage of ZD $V_{CP}$ is higher than the normal forward voltage $V_{A0}$ of LED A. Thus during normal operation of the LED A, the Zener diode ZD does not interfere with the LED A. However, when the LED A fails, $V_A$ will rise until the Zener diode ZD snapbacks and clamps the forward voltage $V_A$ to its clamping voltage $V_{CP}$. The reference voltage $V_{REF}$ is set higher than the normal operation forward voltage $V_{A0}$ of A, and is lower than the clamping voltage $V_{CP}$ of the Zener diode ZD. In one example, the clamping voltage $V_{CP}$ of the Zener diode ZD is about 7V, the forward voltage $V_{A0}$ of the LED A during normal operation is about 4V, and the reference voltage $V_{REF}$ is about 5V. In other embodiments, the Zener diode ZD may be omitted.

Figure 4:
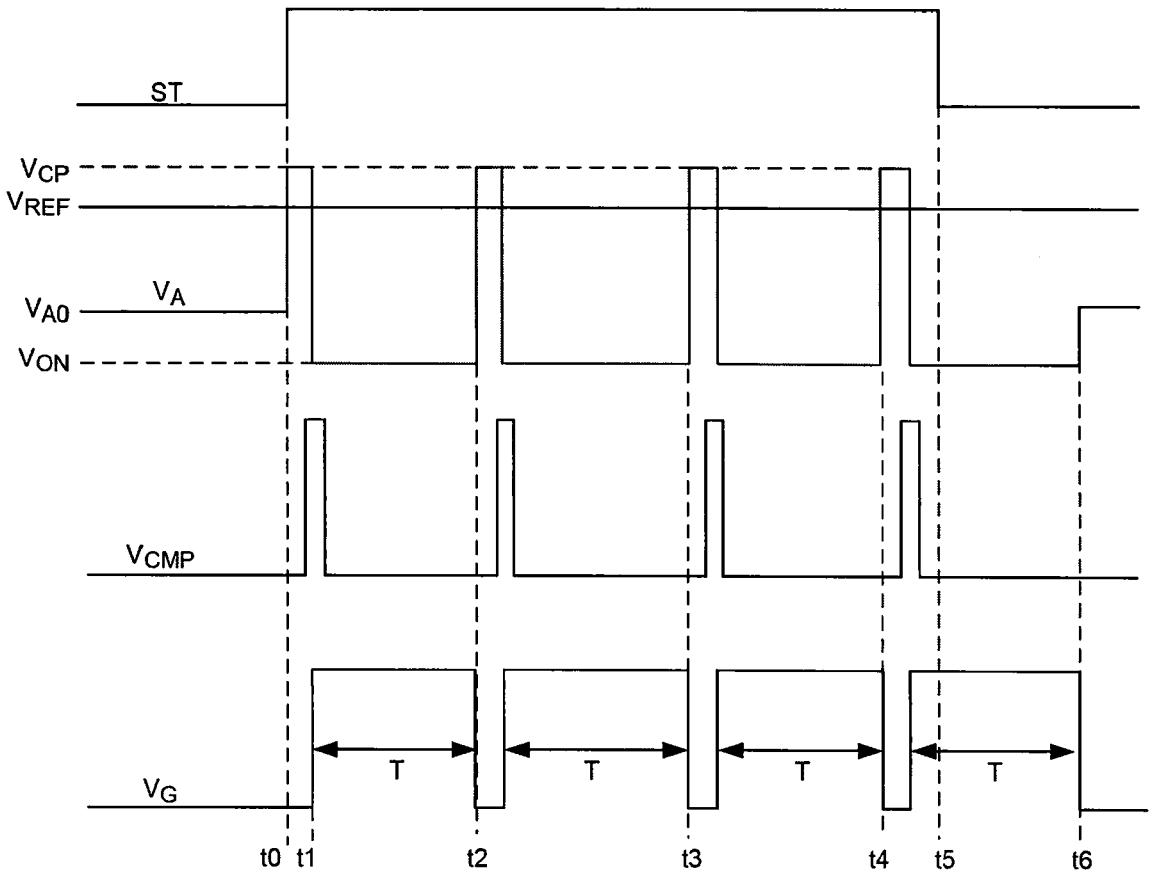
FIG. 4 illustrates waveforms of voltage versus time in the open LED bypass circuit of FIG. 3 during one mode of operation.

The function of the bypass circuit 30 is described below with reference to FIG. 4. As shown in FIG. 4, the signal ST indicates the status of the LED A. LOW ST indicates that the LED A is in normal operation, and HIGH ST indicates the LED A has the open status or has false triggering. The second waveform shows the forward voltage $V_A$ across the target LED A. The third waveform is the output signal $V_{CMP}$ of the comparator U1. And the last waveform is the output signal $V_G$ of the monitoring circuit 31 which drives the gate of the switch M.

Before time t0, the LED A operates in normal status (ST LOW) and the forward voltage $V_A$ is at its normal level $V_{A0}$. The voltages of $V_{CMP}$ and $V_G$ remain in LOW level. The switch M is open. At time t0, the LED A fails and shifts from normal operation to open status (ST HIGH). The power supply voltage of the LED string builds up across the failed LED A, and the voltage $V_A$ across the LED A rises up and is clamped by the Zener diode ZD at the voltage $V_{CP}$. After a short intrinsic delay time, the output signal $V_{CMP}$ of the comparator U1 becomes HIGH and triggers the hold-on circuit 32 to produce a HIGH $V_G$ signal at time t1. Thus the switch M is turned on. The delay time between t0 and t1 is an intrinsic parameter of the circuits, for example, because of the parasitic capacitance. Other conditions (e.g., a voltage spike) can also falsely trigger turning on the switch M.

Once the switch M is turned on, the forward voltage $V_A$ drops to the low on voltage $V_{ON}$ of the switch M. The hold-on circuit 32 holds the signal $V_G$ in HIGH level for a predetermined time period of T. During this time, the voltage $V_A$ is in low level of $V_{ON}$. After the holding on time period of T, at time t2, the hold-on circuit 32 puts out LOW $V_G$ and the switch M is turned off. $V_A$ rises up again and starts another cycle. In this way, the switch M is turned off periodically by the hold-on circuit 32 such that the open LED bypass circuit 30 periodically checks if the failed LED A is healed back to normal operation. If the LED A remains in open status, this operation will repeat by itself. At each cycle, switch M is turned off after a predetermined time of T, referring to time t2, t3, t4, t5 and t6.

During open status, the duty cycle of the signal $V_G$ is determined by the intrinsic delay time (such as the time interval between t0 and t1) as LOW level and the predetermined pulse width of T as HIGH level. The intrinsic delay time can be short. By setting the time period of T, the duty cycle of $V_G$ signal during open status can be very high, which leads to a very low average voltage of $V_A$. The average voltage of $V_A$ during open status is: $DV_{ON}+(1-D)V0$, where D is the duty cycle of signal VG, $V_{ON}$ is the on voltage of the switch M and V0 is the clamping voltage of the Zener diode ZD.

If healing condition is detected (ST LOW), the LED bypass circuit 30 turns off the bypass switch M to allow the healed LED A to operate normally. Referring to time t5, the LED A shifts to healing condition or false triggering situation is eliminated. Once the switch M is turned off at the falling edge of $V_G$ at time t6, the forward voltage $V_A$ rises up to its normal forward voltage $V_{A0}$. Since $V_{A0}$ is smaller than $V_{REF}$, the switch M stays in the off state. Thus, the normal operation of the LED A recovers and is not affected by the bypass circuit 30.

It is noted that the logics of "HIGH" or "LOW" for the logic signals can be in alternative levels since different logic levels can lead to the same result. For example, when $V_A$ is higher than the reference voltage $V_{REF}$, the switch is turned on no matter the $V_{CMP}$ or $V_G$ signal is in logic "HIGH" or logic "LOW".

Figure 5:
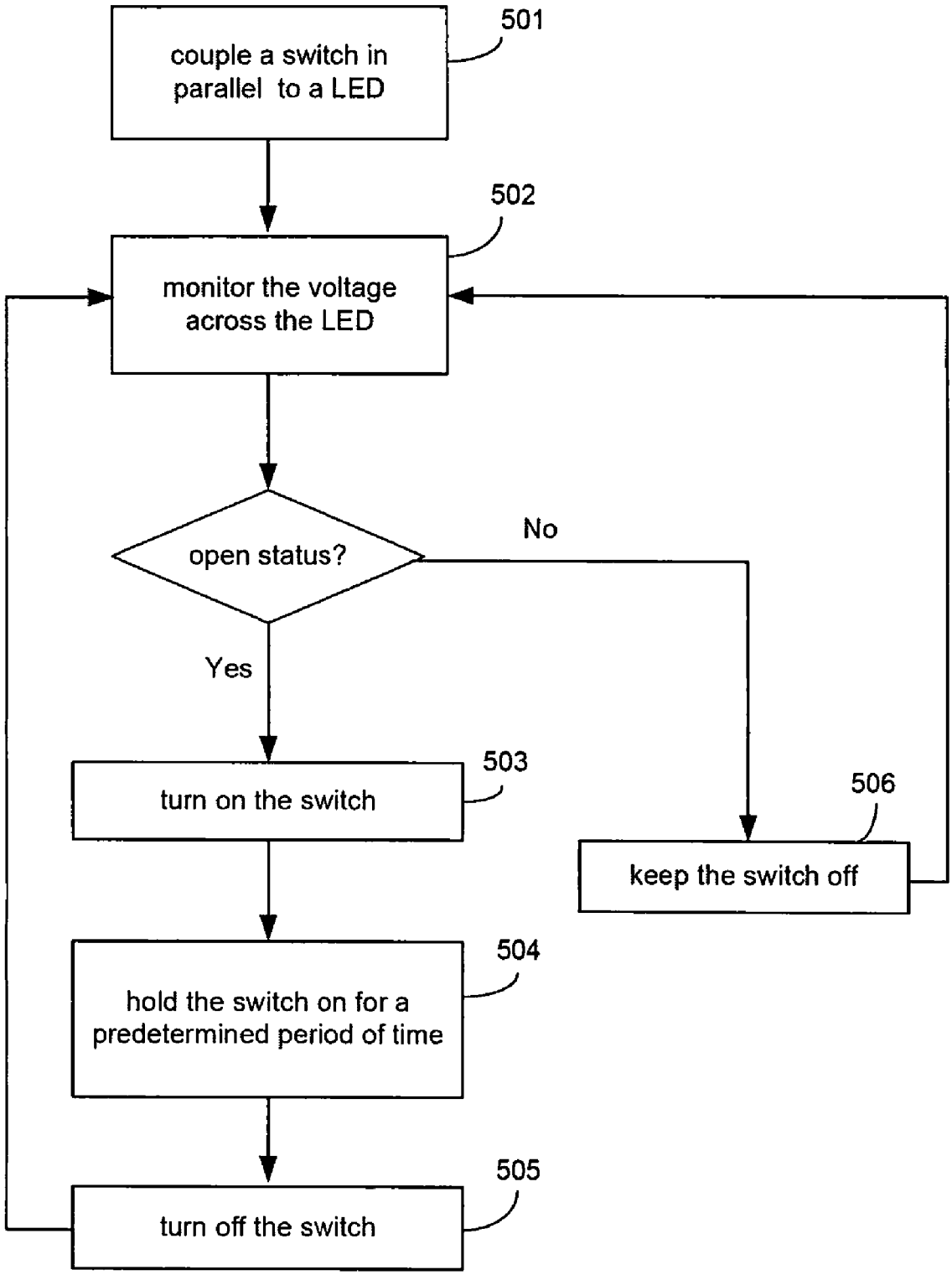
FIG. 5 is a block diagram illustrating a method of bypassing an open LED in a plurality of serially coupled LEDs in accordance with embodiments of the present technology.

FIG. 5 is a block diagram illustrating a method of bypassing an open LED in a plurality of serially coupled LEDs in accordance with embodiments of the present technology. At stage 501, a switch is coupled in parallel to a target LED. At stage 502, a differential voltage across the LED is measured to determined whether the LED is in an open status. In one embodiment, the open status is monitored by comparing the forward voltage across the LED to a predetermined reference voltage. If the forward voltage is higher than the reference voltage, it indicates the LED is in open status.

When the LED fails and open status is detected, then in stage 503, the switch is turned on. Then, the failed LED is periodically checked to see if it is healed back to normal operation with cycles. Thus in stage 504, the switch is maintained for a predetermined period of time, and at stage 505, the switch is turned off at the end of the predetermined period of time. The process reverts to stage 502 to check if the target LED is healed. At stage 502, if healing condition is detected, the LED bypass circuit maintains the bypass switch at an off state at stage 506 to allow the healed LED to operate normally. If the LED is still in open status, the switch is turned on at stage 503 to start another cycle.

From the foregoing, it will be appreciated that specific embodiments of the technology have been described herein for purposes of illustration, but that various modifications may be made without deviating from the disclosure. In addition, many of the elements of one embodiment may be combined with other embodiments in addition to or in lieu of the elements of the other embodiments. Accordingly, the disclosure is not limited except as by the appended claims.

We claim:

1. A circuit, comprising:

a monitoring circuit coupled to a target circuit, the monitoring circuit being configured to monitor a differential voltage across the target circuit, to determine whether an open circuit condition exists based on the monitored differential voltage, and to generate an output signal indicating the open circuit condition; and a bypass switch coupled to the target circuit in parallel, the bypass circuit having a control input coupled to the monitoring circuit to receive the output signal from the monitoring circuit, the switch being configured to be selectively activated to bypass the target circuit in accordance with the output signal indicating the open circuit condition;

wherein during open circuit condition, the switch is configured to be periodically deactivated.

2. The circuit of claim 1, wherein the bypass switch is a MOSFET.

3. The circuit of claim 2, wherein the MOSFET is a LDMOS device integrated with the monitoring circuit on a single semiconductor substrate.

4. The circuit of claim 1, wherein the target circuit is a light emitting diode (LED).

5. The circuit of claim 4, wherein the LED is coupled in series with a plurality of additional LEDs to form an LED string.

6. The circuit of claim 4, wherein when a forward voltage of the LED is higher than a reference voltage, the switch is configured to be activated.

7. The circuit of claim 6, wherein the monitoring circuit comprises a comparator for comparing the forward voltage of the LED to the reference voltage.

8. The circuit of claim 7, wherein the comparator further comprises:

a non-inverting input terminal coupled to an anode of the LED;

an inverting input terminal coupled to the reference voltage; and an output terminal coupled to a gate of the bypass switch.

9. The circuit of claim 4, further comprising a Zener diode having a cathode and an anode, the cathode of the Zener diode being coupled to an anode of the LED and the anode of the Zener diode being coupled to a cathode of the LED.

10. The circuit of claim 9, wherein a clamping voltage of the Zener diode is higher than a forward voltage of the LED.

11. The circuit of claim 10, wherein the monitoring circuit comprises a comparator for comparing the forward voltage of the LED to a reference voltage.

12. The circuit of claim 11, wherein the monitoring circuit further comprises a hold-on circuit having an input and an output, and wherein the input of the hold-on circuit is coupled to an output terminal of the comparator, and wherein the output of the hold-on circuit is coupled to the control input of the bypass switch.

13. The circuit of claim 12, wherein the hold-on circuit is configured to activate the bypass switch for a predetermined period of time and to deactivate the bypass switch after the predetermined period of time expires.

14. A method for bypassing an open LED in a string of LEDs, comprising:

monitoring a differential voltage across the LED;

determining an open status for the LED based on the monitored differential voltage across the LED;

if the open status of the LED is detected, activating a switch coupled to the LED in parallel; and during open status, periodically deactivating the switch and repeating the monitoring and determining operations.

* * * * *